US005500151A

United States Patent [19]

Cao et al.

[11] Patent Number: 5,500,151

[45] Date of Patent: Mar. 19, 1996

[54] HEAVY DUTY FABRIC SOFTENING LAUNDRY DETERGENT COMPOSITION

[75] Inventors: Hoai-Chau Cao, Liege; Marie-Christine Houben, Alleur, both of Belgium

[73] Assignee: Colgate-Palmolive Co., New York, N.Y.

[21] Appl. No.: 285,612

[22] Filed: Aug. 3, 1994

Related U.S. Application Data

[63] Continuation of Ser. No. 44,332, Apr. 7, 1993, which is a continuation of Ser. No. 798,450, Nov. 26, 1991, abandoned, which is a continuation of Ser. No. 672,255, Mar. 20, 1991, abandoned, which is a continuation of Ser. No. 490,863, Mar. 9, 1990, abandoned, which is a continuation of Ser. No. 255,817, Oct. 7, 1988, abandoned.

[51] Int. Cl.[6] ..... C11D 3/12; C11D 3/386; D06M 13/24

[52] U.S. Cl. ..... 252/546; 252/174.25; 252/140; 252/DIG. 7; 252/174.12; 252/DIG. 12

[58] Field of Search ..... 252/8.7, 174.25, 252/140, 546, DIG. 7, 174.12, DIG. 12

[56] References Cited

U.S. PATENT DOCUMENTS

| | | | |
|---|---|---|---|
| 4,436,637 | 3/1984 | Ramachandran et al. | 252/8.7 |
| 4,469,605 | 9/1984 | Ramachandran et al. | 252/8.7 |
| 4,537,706 | 8/1985 | Severson, Jr. | 252/545 |
| 4,569,773 | 2/1986 | Ramachandran et al. | 252/8.7 |
| 4,605,506 | 8/1986 | Wixon | 252/8.75 |
| 4,761,240 | 8/1988 | Rothanavibhata et al. | 252/8.7 |
| 4,769,169 | 9/1988 | Fishlock-Lomax | 252/106 |
| 5,221,495 | 6/1993 | Cao | 252/135 |
| 5,364,553 | 11/1994 | Cao | 252/174.12 |

FOREIGN PATENT DOCUMENTS

| | | |
|---|---|---|
| 0160507 | 11/1985 | European Pat. Off. . |
| 0162600 | 11/1985 | European Pat. Off. . |
| 2178055 | 2/1987 | United Kingdom . |
| 2207144 | 1/1989 | United Kingdom . |

*Primary Examiner*—Paul Lieberman
*Assistant Examiner*—Kery Fries
*Attorney, Agent, or Firm*—Bernard Lieberman; Murray M. Grill

[57] ABSTRACT

A heavy duty fabric softening laundry detergent composition, in liquid form, which has been found to be especially effective in cleaning dirty laundry and in leaving washed laundry feeling softer to the touch, comprises certain proportions of a certain amphoteric detergent, such as is marketed under the trade name Ampholak 7TX, anionic surfactant of the higher alkyl ether sulfate type, nonionic surfactant of the polyethoxylated higher fatty alcohol type, inorganic builder and bentonite, in an aqueous medium. Also within the invention are washing processes in which such laundry detergent compositions or components thereof are employed.

The liquid detergent described is of a pH in the range of 7 to 8 and of a viscosity in the range of 1,500 to 2,500 cps. at 25° C., and it is stable on storage. The surfactants, bentonite, builder and enzyme (optional) are dissolved, emulsified or suspended therein, and the enzyme retains enzymatic activity even after normal storage.

Apparently due to synergism with the rest of the surfactant system, the amphoteric surfactant increases the cleaning activity of the liquid detergent composition on laundry to a greater extent than would have been expected, especially when the laundry is of fabrics made from cotton/polyester fiber blends, and the amphoteric surfactant, which is not a fabric softener, also synergistically increases the fabric softening activity of the bentonite.

12 Claims, No Drawings

HEAVY DUTY FABRIC SOFTENING LAUNDRY DETERGENT COMPOSITION

This is a continuation of application Ser. No. 08/044,332, filed Apr. 7, 1993, which is a continuation of application Ser. No. 07/798,450, filed Nov. 26, 1991, now abandoned, which is a continuation of Ser. No. 07/672,255, filed Mar. 20, 1991, abandoned, which is a continuation of Ser. No. 07/490,863, filed Mar. 9, 1990, abandoned, which is a continuation of Ser. No. 07/255,817, filed on Oct. 7, 1988, now abandoned.

This application relates to heavy duty fabric softening laundry detergent compositions. More particularly, it relates to such compositions, in liquid form, which include anionic and nonionic surfactants, a certain type of amphoteric surfactant, inorganic builder, bentonite and water. Also within the invention are processes for washing laundry with such detergent compositions or with the components thereof, which washing results in unexpectedly improved cleaning and synergistic softening of the laundry.

Heavy duty built particulate synthetic organic laundry detergent compositions have been extensively marketed for at least the last fifty years, since shortly after synthetic organic detergents became commercially available and their advantages over soap-based detergent compositions were recognized. Although for many years spray dried built particulate synthetic organic detergent compositions were most successful, liquid state products have recently become increasingly popular. Among reasons given for such improved consumer acceptance are 1) better pourability, 2) lack of dusting, 3) easier measuring, 4) lesser volume, so less store shelf space is required, and in some cases, as in Europe, 5) automatic washing machines with internal dispensing equipment for detergents can measure and dispense such liquids better than they can measure and dispense particulate solid compositions. However, with the advent of liquid state detergent compositions various problems were noted which had not been encountered with spray dried products or dry detergent composition mixes. Particulate solid state components of the detergent compositions are less likely to react with each other during even lengthy periods of storage than they are when such components are in liquid state, especially in aqueous media. Some materials precipitate out from solutions upon cooling or heating and others, which are not soluble in the liquid medium, and have to be emulsified, dispersed or suspended therein, tend to precipitate or to separate during storage. Thinning, gelation, degradation and decomposition are other problems that may be encountered when a product is in liquid state. Extensive research has been undertaken in efforts to make stable and effective liquid detergent compositions, and such research has yielded various significant advances in the art. Nevertheless, efforts to make better and more stable liquid detergent compositions are continuing and are being rewarded by beneficial discoveries, some of which might have been expected, but some of which were not predictable, as in the present invention.

One of the properties of synthetic organic detergent compositions that is disadvantageous, compared to the replaced soap products, is that of leaving washed laundry feeling harsh to the touch. It has been observed that soaps leave on the washed laundry a film of water insoluble soap, created by reaction between the soluble soap and water hardness metallic ions, such as calcium ion, which film lubricates the fibers of the laundry fabrics and makes the fabrics feel softer to the touch. Synthetic organic detergents normally leave laundry clean but often leave it harsh to the touch, because of the absence of the insoluble soap lubricant. In efforts to soften the washed laundry various fabric softening agents have been employed in synthetic organic detergent compositions, such as quaternary ammonium halides and/or bentonite. Finely divided bentonite solids can deposit on the fibers of the laundry and lubricate them, making them feel soft. However, bentonite, especially swelling and/or gelling bentonite, sometimes referred to as sodium bentonite, may cause changes in product viscosity on storage, due to its swelling or gelling nature, can separate out from liquid detergents and can form gels. Other liquid detergent components, such as enzymes, which may be employed in detergent compositions to promote cleaning, tend to degrade on storage in liquid media, especially in aqueous media.

As a result of experimentation, the object of which was to produce an improved heavy duty liquid fabric softening laundry detergent composition, it was discovered that a combination of anionic and nonionic surfactants with a certain type of amphoteric detergent, which has been marketed under the name Ampholak 7TX, the structural formula for which will be given below, bentonite, inorganic builder salt and aqueous medium resulted in a liquid state product of outstanding cleaning properties, greater than would have been expected from knowledge of the cleaning powers of the components thereof, and also resulted in a synergistic improvement in the fabric softening effect of the bentonite. Such improvements were so surprising and the result so gratifying that the product is a prime candidate for commercial marketing in the near future.

In accordance with the present invention a heavy duty liquid fabric softening laundry detergent composition, which is of improved fabric softening and cleaning properties, comprises 0.3 to 15% of amphoteric surfactant of the formula $$R-(\underset{\underset{T}{|}}{N}-[CHR^1]_x)_y-\underset{\underset{T}{|}}{N}-W,$$

wherein R is a hydrocarbyl group of 8 to 20 carbon atoms, is $R^1$ hydrogen or alkyl of 1 to 6 carbon atoms, $R^2$ is alkylene of 1 to 6 carbon atoms, T is hydrogen or W, W is $R^2COOM$, M is hydrogen, alkali metal, alkaline earth metal, ammonium or substituted ammonium, x is 2 to 3 and y is 2 to 4, 1 to 20% of anionic surfactant, 1 to 10% of nonionic surfactant, 5 to 30% of water soluble inorganic builder salt, 5 to 20% of bentonite, and 30 to 85% of aqueous medium, with all percentages being by weight. The anionic surfactant may be any suitable such material but is preferably a higher alkyl poly-lower alkoxy ether sulfate, ether carboxylate or ether carboxymethylate. Such surfactants are water soluble salts, usually being alkali metal salts, such as those of sodium. The nonionic surfactant is preferably a condensation product of a higher fatty alcohol of 10 to 18 carbon atoms with 3 to 15 moles of ethylene oxide per mole of fatty alcohol but other nonionics may be substituted. The builder salt is preferably selected from the group consisting of polyphosphates, carbonates, silicates and borates, which are usually alkali metal salts, preferably sodium salts. Other useful detergents and builders will be mentioned later.

The invented liquid detergent compositions preferably also comprise enzyme, polyacrylate, higher fatty acid soap, enzyme stabilizer, e.g., dibasic acid-boric acid mixture, normally present as calcium salts of such acids, and fluorescent brightener (which is sometimes referred to as optical brightener), preferably of the distilbene type. Although the stability advantages of the present liquid detergent compositions over control liquids will not be realized when particulate detergent compositions are made from required components of the liquids, without the aqueous medium, the performance advantages are obtained so the inventive concept also embraces particulate, solid, paste, gel and other forms of detergent compositions that comprise 0.3 to 15 parts of the amphoteric surfactant, 1 to 20 parts of the anionic surfactant, 1 to 10 parts of the nonionic surfactant, 5 to 30 parts of builder salt and 5 to 20 parts of bentonite, with all such parts being by weight. For European type particulate detergent compositions there may also be present, 5 to 30 parts of sodium perborate ($NaBO_2.H_2O_2$ basis). Also within the invention are processes for washing and softening laundry by use of the invented compositions or the components thereof.

A search for relevant prior art has resulted in the finding of the following publications, none of which anticipates the invention. It is considered that none of them makes it obvious, either alone or combined. Following is a listing of the art found: British specifications 2,132,629; 2,170,235; and 2,178,055; and European specifications 0,162,600; and 0,214,868.

British specification 2,132,629 discloses stable pourable liquid detergent compositions comprising sodium alkyl polyethoxy sulfate, sodium alkylbenzene sulfonate, sodium tripolyphosphate, bentonite and water. British specification 2,170,235 discloses a similar composition but also includes N-higher alkyl isostearamide as a fabric softener. British specification 2,178,055 describes a stabilized built liquid detergent composition similar to those previously mentioned but also including an enzyme and an enzyme stabilizing system. Such specification teaches that nonionic and amphoteric detergents may also be present but the amphoteric surfactant specified as a component of the present invented compositions is not mentioned and no specific compositions with preferred nonionic detergents of the present specification are disclosed. Dicarboxylic acids were disclosed in British 2,178,055 as components of an enzyme-stabilizing system. European patent specification 0,162,600 describes the preferred amphoteric surfactant that is present in applicants' liquid detergent compositions and teaches that such is a useful component of liquid detergents. Synergism with nonionic surfactant was disclosed therein as accounting for improved cleaning noted but such synergism was attributed to the employment of two different types of amphoterics with the nonionic surfactant, rather than to a combination of the nonionic surfactant, anionic surfactant and amphoteric surfactant in applicants' compositions. No anionic surfactants were described as components of the reference compositions (probably because anionic surfactants have interfered with the cleaning action of amphoteric surfactants, even in alkaline media) and no bentonite is present in the reference compositions. No mention is made in that reference of any synergism affecting the fabric softening capability of bentonite. European patent specification 0,214,868 describes the preferred amphoteric surfactant of the present invention and discloses it in a liquid detergent formula in which neither bentonite nor anionic surfactant is present. Thus, from the art discussed it is clear that although components of the present compositions have been disclosed in liquid detergent compositions, applicants' compositions are novel. It is submitted that such compositions are also unobvious from the art mentioned, especially in view of synergistic fabric softening and cleaning effects obtained.

The mentioned prior art specifications are incorporated in this disclosure by reference, for their descriptions of the amphoteric surfactants and other components of the invented compositions.

Of the detergent components of the invented compositions a key member is the amphoteric surfactant, which is of the formula

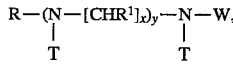

wherein R is a hydrocarbyl group, preferably aliphatic, of 8 to 20 carbon atoms, $R^1$ is hydrogen or alkyl of 1 to 6 carbon atoms, preferably hydrogen, $R^2$ is alkylene of 1 to 6 carbon atoms, preferably methylene, T is hydrogen or W, preferably W, W is $R^2COOM$, M is hydrogen, alkali metal, alkaline earth metal, ammonium or substituted ammonium, such as lower alkanolammonium, e.g., triethanolammonium, x is 2 to 3 and y is 2 to 4. A preferred amphoteric surfactant is of the formula

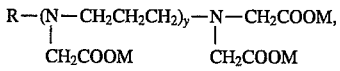

wherein R is an aliphatic hydrocarbyl, preferably fatty alkyl or fatty alkylene, of 16 to 18 carbon atoms, M is alkali metal, and y is 3 to 4. More preferably R is tallowalkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Among the more preferred amphoteric surfactants of this type is that available commercially under the trade name Ampholak™ 7TX, which is obtainable from Kenobel AB, a unit of Nobel Industries Sweden.

An operative anionic surfactant component of the invented liquid detergents is a water soluble salt of lower alkoxylated higher fatty alcohol sulfuric acid in which the higher fatty alcohol is of 8 to 20 carbon atoms, preferably 10 to 18, e.g., 12. The extent of alkoxylation will be such as to make the product water soluble and give it a desirable HLB number, such as that which results when 2 to 6 moles of ethylene oxide are present per mole of higher alcohol, e,g., lauryl. Instead of ethylene oxide as the only alkoxy component, mixtures of ethylene oxide and propylene oxide may be employed, but the total moles of alkylene oxide will be in the 4 to 9 range. Normally the sulfate will be an alkali metal, alkaline earth metal, ammonium or substituted ammonium salt, as was described for M in the formula of the amphoteric surfactant. Preferably this anionic surfactant will be an alkali metal higher alkyl ether sulfate which is an alkali metal salt of ethoxylated higher fatty alcohol sulfuric acid in which the higher fatty alcohol is of 10 to 14 carbon atoms and is ethoxylated with 2 to 4 moles of ethylene oxide per mole of higher fatty alcohol. More preferably, in such anionic surfactant, the alkali metal is sodium, the higher fatty alcohol moiety is of about 12 carbon atoms and the ethoxy moiety is of about 3 ethoxy groups, which surfactant has been referred to as sodium lauryl ether sulfate. Although the higher fatty alcohol polyethoxy sulfates are often preferred anionic surfactants one may substitute for them, in whole or in part, corresponding ether carboxylates or carboxymethylates, which are obtainable from Sandoz, Inc., and the same desirable results are obtainable. In such anionic surfactants and others that may be employed in practicing the invention the lipophile thereof will normally include an alkyl or alkenyl of 8 to 20 or 10 to 18 carbon atoms.

A broad variety of nonionic surfactants may be used in the invented compositions but preferably such nonionic surfactant is a condensation product of a higher fatty alcohol of 10 to 18 carbon atoms with 3 to 15 moles of ethylene oxide or mixed lower alkylene oxides (ethylene oxide [EtO] and propylene oxide [PRO]) per mole of higher fatty alcohol. Preferably such nonionic surfactant is a condensation product of a higher fatty alcohol of 12 to 16 carbon atoms with 3to 13 moles of lower alkylene oxide per mole of higher fatty alcohol. More preferably the higher fatty alcohol moiety is of 12 to 15 carbon atoms and the ethoxy moiety is about 5 ethoxy groups. If foam control is a problem with a particular composition based on ethoxylated nonionic surfactant it has been found that employing a mixture of EtO and PrO in the nonionic surfactant helps to control foaming. Usually the content of EtO is greater than that of PrO, such as in a $C_{14,15}$ alcohol-7 EtO, 4 PrO block copolymer condensation product. The EtO content is sufficient to solubilize the nonionic detergent, the PrO controls foam, and the product is of a desirable HLB number. In the described condensation products the ethoxylate moiety may be of either BRE or NRE (broad range ethoxylate or narrow range ethoxylate) types. Effective detergent compositions result when BRE's are used but NRE formulas are as good or better, and liquid detergents based on NRE's have been found to be better in detergency, especially against oily soils.

Although the described surfactants are those of the most preferred embodiments of the present invention and are considered to be important constituents of the liquid detergent compositions that yield the described unexpected beneficial improvements in cleaning power and fabric softening, it is within this invention to employ other surfactants in addition to the mentioned surfactants and sometimes in replacements thereof. When such other surfactants are employed useful liquid detergent compositions may be obtained but the cleaning and fabric softening advantages thereof may not be as great. Therefore, it is considered to be desirable that preferred surfactants of the types previously mentioned constitute at least 80% of the surfactant content of the liquid detergents. Descriptions of other amphoteric, anionic and nonionic surfactants, preferably detergents, may be found in the text *Surface Active Agents,* Vol. II, by Schwartz, Perry and Berch (Interscience Publishers, 1958), and in a series of annual publications entitled *McCutcheon's Detergents and Emulsifiers,* for example, that which was issued in 1980, the descriptions of which are incorporated herein by reference. Of such other anionic detergents some examples are the linear higher-alkylbenzene sulfonates, fatty alcohol sulfates, paraffin sulfonates, olefin sulfonates, monoglyceride sulfates, sarcosinates and sulfosuccinates, and of these the sulfates and sulfonates are preferred. Of the nonionic detergents some others include block copolymers of ethylene oxide and propylene oxide (Pluronics®), mixed copolymers of ethylene oxide and propylene oxide, and condensation products of ethylene oxide and alkylphenols, such as condensation products of 3 to 10 moles of ethylene oxide with nonylphenol. Among supplementary amphoteric surfactants there may be mentioned the alkyl ammonium sulfonic acid and the acylamidoammonium sulfonic acid betaines, imidazolines and derivatives thereof, polyethoxy aminoacid salts, and those surfactants known as Miranols®. Additionally, ampholytic and zwitterionic surfactants are sometimes employed, and cationic surfactants may be useful too, such as fatty amine ethoxylates and other cationics that may be present on the bentonite or complexed with it.

The built heavy duty laundry detergent composition includes water soluble inorganic builder salts, which act to improve the detergency of the surfactant combination. Among the most effective builders are the phosphates, particularly the polyphosphates, such as tripolyphosphates and pyrophosphates, but in those instances where laws or regulations prohibit phosphates from being included in detergents or limit the proportions thereof present in detergent compositions, non-phosphate builders may be substituted for the phosphates, either in whole or in part. Among such other builders are the carbonates, including bicarbonates, silicates, including sesquisilicates, and berates, including borax. Other builders such as those of the organic type and those which are water insoluble and inorganic, such as zeolites, which may be 5 to 15% of the products. Among the organic builders there may be mentioned polyacetal carboxylate (which had been available from Monsanto Corp., as Builder U), sodium citrate, sodium gluconate, NTA, and EDTA. When water soluble inorganic builder salts are utilized in the present compositions at concentrations in the aqueous medium greater than the solubilities of the salts, or when the builder employed is water insoluble, such as a zeolite builder, it is highly desirable that the builder particles be finely divided, such as in particles of sizes less than No. 200, and often preferably less than No. 325, U.S. Sieve Series, when charged to the mixer with the liquid medium, so as to promote dispersion of any undissolved materials and so as to avoid settling out thereof.

The bentonite component of the present compositions is preferably a swelling or gelling bentonite because it has been found that such bentonites, are better fabric softening agents than those which are non-swelling and non-gelling. Wyoming and western bentonites, which include substantial proportions of sodium bentonite, are among the better swelling bentonites but non-swelling bentonites may be treated with sodium carbonate or with other source of alkali metal to convert them to swelling type (by introducing sodium into the bentonite in place of heavier metals). Such bentonites are also useful for the manufacture of the present compositions and often may be economically advantageous, especially for products to be marketed in Europe, because the cost of processing can be less than the expense of transportation of the bentonite from America.

Among the various commercial bentonites available some which are preferred are those sold under the trade names: Hi-Jel, different types and grades of which are sold as Hi-Jels No's. 1–4; DK-129 (Georgia Kaolin Co.); Polarite KB 325 (American Colloid Co.); Laundrosil DG; Laviosa AGB; Winkelmann G-13; and Detercol P2. Chemical analyses of some bentonites used to make the liquid detergents of the present invention have been made and such analyses indicate that some useful bentonites may contain 64.8% to 73.0% of $SiO_2$, 14 to 18% of $Al_2O_3$, 1.6 to 2.7% of MgO, 1.3 to 3.1% of CaO, 2.3 to 3.4% of $Fe_2O$, 0.8 to 2.8% of $Na_2O$ and 0.4 to 7.0% of $K_2O$. The bentonite will desirably be of particle sizes that pass through a No. 200 sieve and preferably will pass through a No. 325 sieve (U.S. Sieve Series) when it is mixed with the other components of the liquid detergent in the liquid medium.

The last of the specified components of the invented composition is the liquid medium, in which the other components are dissolved, emulsified, coacervated, dispersed and/or suspended, so that the composition is substantially homogeneous and so that such homogeneity is maintainable during reasonable storage periods after manufacture and before use. While some non-aqueous media have been employed for liquid detergent compositions, the medium for the present compositions is very desirably aqueous, although co-solvents, such as lower alkylene glycols, lower alkanols and polyoxy-lower alkanols, e.g., polyoxyethylene glycol, may also be employed, but desirably the medium will be substantially aqueous, normally being over 50% water, preferably over 80%, more preferably over 95%, and in many instances being 100% of water, with any balance of such medium being other normally liquid solvent, such as ethanol or isopropanol. In the most preferred embodiments of the invention the liquid medium is all water.

In addition to the specified components of the present liquid detergent compositions various supplemental components or adjuvants may also be incorporated. Among these there may be mentioned enzymes of various types, including proteolytic, amylolytic, lipolytic, cellulytic and carbohydroxylytic enzymes, all of which are commercially available. Many enzymes lose enzymatic activity in aqueous media and therefore enzyme stabilizers are employed. Some such materials include a source of calcium ion, such as calcium chloride or calcium hydroxide, boric acid, and various dicarboxylic acids, such as succinic, adipic and glutaric acids. Polyacrylic acid and polyacrylates, such as sodium polyacrylate of low molecular weight, such as 1,000–5,000, are useful deflocculants, assist in controlling the viscosity of the liquid detergent, and may help to improve cleaning by such detergent composition. Higher aliphatic acids such as fatty acids of 10–18 carbon atoms, especially saturated fatty acids and soaps made from them, e.g., sodium hydrogenated coco soap, help to reduce excessive foaming of liquid detergents, which might otherwise result, due to the presence of anionic detergent therein. Of course, many liquid detergents will be given an attractive color, often blue, by use of suitable dyes, and the products will usually be pleasantly perfumed. The pH of the final product will desirably be in the range of 6.5 to 10.5, e.g., 7 to 8, and pH adjusting chemicals, such as acids, bases and buffers, may be employed to obtain the optimum pH. Sodium hydroxide solution may be utilized as an alkaline pH adjusting agent, in addition to its desirable function of in situ neutralizing any acidic materials that may be present. Fluorescent or optical brighteners, such as the well-known substantive stilbene brighteners, e.g., Tinopal® 5BM Conc., Tinopal LMS-X and Blancophors, are also useful components of the liquid detergent compositions and help to give washed laundry a brighter appearance. Other adjuvants that have been employed in liquid detergent compositions may also be incorporated in the present products, including: anti-redepotion agents, such as sodium carboxymethyl cellulose and hydroxypropylmethyl cellulose; suspension stabilizing agents, including acrylic-maleic copolymers; soil release promoters, such as copolymers of polyethylene terephthalate and polyoxyethylene terephthalate, e.g., Alkaril® QCJ; buffers, such as sodium propionate; ultraviolet absorbers; sequestrants, such as ethylene diamine tetraacetates; anti-oxidants; and antistatic agents, such as N-higher alkyl isostearamides and N-higher alkyl neodecanamides.

The proportions of the various components of the invented liquid detergent compositions will be such as to result in an effective detersive and fabric softening composition of desired physical properties (stability, viscosity, pH and aesthetic properties). Thus, the total proportion of surfactant components will be a detersive proportion, that of builder will be a building proportion, that of bentonite will be a fabric softening proportion and that of the aqueous medium for such will be a dissolving and suspending proportion. Normally, the proportion of amphoteric surfactant will be in the range of 0.3 to 15%, preferably being 0.5 to 5% and more preferably being 1.5 to 4%. The anionic surfactant content will usually be in the range of 1 to 20%, preferably 2 to 15% and more preferably 3 to 10%, while the corresponding ranges for the nonionic surfactant are 1 to 10%, 2 to 8% and 2 to 5%. The water soluble inorganic builder content is normally maintained in the range of 5 to 30%, preferably 10 to 25% and more preferably 10 to 20%. It is preferred for detergent compositions containing phosphate builders that the proportion of such builder(s) therein should be in the range of 5 to 25%, preferably 10 to 25% and more preferably 10 to 20%. Incidentally, although the water soluble builder is completely soluble in the wash water at normal use concentrations, part is essentially suspended in the liquid detergent composition because the amount present is in excess of that which is soluble in the liquid medium. The bentonite content will be in the range of 1 to 20%, preferably being 4 to 15%, and more preferably being 7 to 13%. The aqueous medium, preferably water, will constitute 30 to 80% and more preferably 40 to 75% thereof. For other constituents of the invented compositions, the percentage of polyacrylate will normally be in the range of 0.1 to 2% and preferably is in the range of 0.2 to 1%; the proportion of higher fatty acid soap is normally in the range of 0.5 to 5%, preferably 1 to 3%, and the total of dibasic acids of 4 to 6 carbon atoms is also 0.5 to 5%, preferably 1 to 3%. Such percentages for the fatty acid soap and the dibasic acids are on the bases of the acidic forms thereof, although it is recognized that in alkaline media the neutralized or ionic forms may be present. The proportions given herein apply to the mixture of three dibasic acids (succinic, glutaric and adipic acids), whether they are present the 1:1.6:1 proportion preferred or in other proportions within the ranges of 1:1–3:0.5-2, which are also acceptable. Proportions of other components of the composition are in the ranges of 0.01 to 1% of enzyme, preferably proteolytic, on an active component basis, that corresponds to 0.1 to 2%, preferably 0.2 to 1% on the basis of the enzyme as supplied (with carrier), which ranges are those referred to herein, including the claims; 0.1 to 0.5% of a source of calcium ion, preferably 0.2 to 0.4%; 1 to 3% of boric acid (or borax), preferably 1.5 to 2.5%; and 0.05 to 0.5% of stilbene optical brightener, preferably 0.2 to 0.4%, which is on the basis of the product being supplied by the manufacturer. The proportion of enzyme stabilizers, which include a source of calcium ion, boric acid and dicarboxylic acids, may be in the range of 0.3 to 5.x or 6%. Neutralizing agent, such as alkali metal hydroxide, alkaline earth metal hydroxide, and lower alkanolamine, may be present in sufficient proportion to produce a desired pH, such as one in the range of 6.5 to 10.5. Percentages of perfume and colorant can be conventional and are both usually less than 2%, with colorant often being less than 0.1%. The total percentage of other adjuvants which may be present in the invented liquid detergent compositions will normally be relatively small, usually being less than 10% of the composition, preferably less than 5% thereof and often being less than 2%, e.g., 0%.

Conventional manufacturing methods may be employed to a large extent in the production of the described liquid detergent compositions. In one procedure a portion of the aqueous medium may be added to a mixing vessel and the surfactant components may be mixed therewith in any suitable order, such as anionic, nonionic and amphoteric detergents, followed by higher fatty acid and mixed dicarboxylic acids and neutralizing agent, such as sodium hydroxide solution. Then sodium tripolyphosphate and/or other builders may be added, followed by polyacrylate, enzyme and enzyme stabilizer(s). Bentonite may be premixed with another portion of the water or may be added directly to the composition, sometimes with additional water, after which the balance of the water, brightener, dye and perfume may be admixed. When other components of the detergent composition are also employed they may be added to the mixer at appropriate times and the various orders of addition may be modified to make them appropriate to the types of products being made and to the types of equipment being used.

The heavy duty liquid detergent compositions produced are primarily intended for use in automatic washing machines, for the washing of mixed soiled family laundry that will largely be of cotton and cotton/polyester blend fabrics. In the automatic washing machine operation the wash water may be of any hardness, and good performance will be obtained, but usually the range of hardnesses will be 0 to 400 p.p.m., as calcium carbonate. The washing temperature may be in the range of 10° to 90° C. and in many European washing operations it will be in the range of 30° to 90° C., (for energy savings the high limit of this range may be kept to 60° C.) and the concentration of the liquid laundry detergent will be in the range of 0.1 to 3%, preferably being 1 to 2% for European washing. While the present invention is primarily of a fabric softening liquid detergent, which is sometimes referred to as a softergent, it is evident that with respect to the washing process similar good results are obtainable by utilizing the components of the composition and adding them to the wash water separately, in sub-groups of components, or as particulate solids.

The invented softergent is found to be a very satisfactory competitive softergent product and is rated high against successful commercial liquids of such type. It is satisfactorily stable for over six months at room temperature, without settling out of components, and the enzyme(s) component(s) is/are still effective after such storage. In comparative washing tests it is found to be of unexpectedly improved cleaning power, especially against cotton/polyester blend laundry, despite the fact that the total detergent concentration was increased in the "control" so as to be greater than in the "experimental" formula. Such result is apparently due to its combination of anionic and nonionic surfactants with the described amphoteric surfactant, in the present compositions, which also contain bentonite. The blend of surfactants results in better whitening of soiled laundry than would be expected from a knowledge of detersive characteristics of the individual components of the blend, which is indicative of synergism between such components in the described compositions. Even more unexpected is the improvement in fabric softening of the invented composition, which is attributed to synergism between the amphoteric surfactant and the bentonite, in such compositions, with the fabric softening action of the invented compositions being surprisingly better than that for similar compositions that do not contain the amphoteric surfactant.

The following examples illustrate but do not limit the invention. All parts are by weight and all temperatures are in °C., unless otherwise noted, in the examples and in the rest of the specification, including the claims.

EXAMPLE 1

| Component | Percent, by weight (as active component) |
|---|---|
| Alcosperse ® 149 (40% sodium polyacrylate) | 0.60 |
| Sodium tripolyphosphate | 15.00 |
| Distilbene-type fluorescent brightener (Tinopal ® LMS-X) | 0.30 |
| Calcium chloride | 0.20 |
| Coco fatty acid | 1.50 |
| * Nonionic surfactant | 3.00 |
| ** Amphoteric surfactant | 3.75 |

-continued

| Component | Percent, by weight (as active component) |
|---|---|
| *** Anionic surfactant | 5.00 |
| Sodium hydroxide (50% aqueous solution) | 1.20 |
| Bentonite (Laundrosil ® DG, supplied by Süd Chemie) | 11.00 |
| Boric acid | 2.00 |
| + Dibasic acid mixture | 2.00 |
| Acilan blue dye (1% aqueous solution) | 0.002 |
| Perfume | 1.00 |
| ++ Proteolytic enzyme (solids basis) | 0.50 |
| Preservative (Kathon ™ 886) | 0.0015 |
| Water | 52.946 |
| | 100.0 |

* Condensation product of $C_{13-15}$ alcohol with 5 moles of ethylene oxide (Dobanol ® , from Shell Chemical Company)
** Ampholak ® 7TX (aqueous solution in water of 30% of amphoteric surfactant and 9% of sodium chloride contents, with the amphoteric surfactant being as described in European patent specification No. 0,214,868, and including a tallowalkyl moiety)
*** Sodium lauryl ether sulfate, 70% solids, 30% water, containing 3 moles of ethylene oxide per mole
+ 1:1.6:1 Mixture of succinic, glutaric and adipic acids, approximately (Sokalan ® DCS, supplied by BASF)
++ Alcalase ® 2.5L, Type A, supplied by Novo Industrii The liquid softergent of this example may be made by the manufacturing process that was previously described. The product is an attractive blue opaque liquid, of a viscosity of about 2,000 cps. at 25° C., and of a pH of about 7.2, in which the various components are dissolved and/or dispersed. The product is acceptably stable and it will be of a shelf life of at least six months, during which period it will not gel objectionably, its components will not separate and the enzyme component will retain its activity. In the event of any minor separations after longer storage times the product may readily be made homogeneous again by gentle shaking.

In variations of this example an equivalent proportion of calcium hydroxide may be substituted, for the calcium chloride, boric acid may be replaced by borax, and the final pH of the product may be in the range of 7.2 to 7.5 (which produces a wash water pH in the range of 8.6 to 8.8 at 1.5% concentration, by weight, of the liquid detergent composition in the wash water. The modified product is of essentially the same properties as the unmodified product.

EXAMPLE 2

(Control)

A composition like that of Example 1 is made by the procedure described therein but the formula is changed, with amphoteric surfactant being omitted, with the proportion of anionic surfactant being doubled and with the proportion of water charged being adjusted accordingly. The increase in anionic surfactant content is effected so that comparative testings of the products of Examples 1 and 2 would not be weighted against the control, due to its having a lower total surfactant content. In fact, the control formula now includes more surfactant than the experimental, on an experimental surfactant content weight basis, so such comparative testing is weighted against the invented composition instead.

EXAMPLE 3

(Comparative Testing)

The invented composition of Example 1 was tested against the control of Example 2 and against a market leading commercial liquid laundry detergent composition, for whitening and softening of washed laundry. In such tests a mini-washing machine was employed (Miniwascator) and the tests were repeated three and six times, using the same test samples, to simulate repeated launderings of family wash. The temperature of the wash water in these tests was maintained at 60° C., the hardness of the wash water was about 200 p.p.m., as $CaCO_3$, and the concentration of the liquid detergent in the wash water was 1.5% (by weight). Normal wash and rinse cycles were utilized and the laundry was dried in a normal drying cycle (for the material) in an automatic laundry dryer. The materials washed were of cotton and cotton/polyester blends (35/65).

In whitening (or cleaning) tests, which also measure the extent of redeposition of soil on the washed materials, after six washing and drying cycles of the type described herein cotton test swatches washed with the softergent composition of Example 1 were noticeably whiter than such swatches washed with the composition of Example 2 and were very significantly whiter than when commercial liquid detergent was used. Similar results were obtained when the test swatches were of cotton/polyester blends but in such case the improvement over the control is even greater. Such improvement was also obtained, although not to the same extent, for single cycle and triple cycle washings of the cotton/polyester blends. The experimental softergent was also very significantly better than the commercial liquid detergent for the single wash, triple wash and sextuple wash treatments. Although the data, which were evaluated by regression analysis techniques for the mentioned whiteness comparisons, were obtained by taking reflectometer readings, differences in whiteness were readily visible to panels of experienced observers and also even to casual observers, and were in the same comparative orders as previously reported in this Example.

The cotton test swatches washed with the experimental, control and commercial products were also evaluated for softness by panels of experienced observers, and measures of comparative softnesses were determined by regression analysis. It was thus established that the experimental (or invented) product of Example 1 was better than that of Example 2 in softening cotton test swatches and such swatches (washed with the composition of Example 1) were much softer than swatches washed with the commercial liquid detergent. Such improvements in softening resulted after one, three and six washing-drying cycles, with the improvements after multiple cycles being greater than those after a single cycle treatment, and being considered to be significant.

Tests of stain removal activities of the experimental, control and commercial liquid detergent compositions against a standard variety of stains on cotton and on cotton/polyester blends show that the experimental formula is as good as the control in overall stain removal and is better than it in removing stains from cotton/PE blends, despite the lower surfactant content of the experimental formula.

From the observations of improved whitening and softening of test fabric swatches after multiple treatments with the invented liquid softergent, as reported above, it appears that a mechanism that might explain such phenomena could involve a depositing of one or more components of the present compositions, such as amphoteric surfactant and bentonite, on the laundry, which would additively affect subsequent washings of the laundry or depositions of bentonite thereon. Such effects have not been described in the literature and it is not considered that they would be obvious for applicants' compositions. Whether the desirable effects are explainable or not, they are significant and unexpectedly beneficial, and result from synergism between components of the invented compositions.

Another such beneficial phenomenon is the noted improved stability of the enzyme on storage of the present compositions, compared to conventional liquid detergent, in which the surfactant is primarily anionic. As a result, the invented compositions are better removers of biological stains than the control and the commercial liquid detergent. Yet another improvement in product properties is the raising of the cloud point of the nonionic surfactant by the present amphoteric surfactant in these formulas, even in the presence of electrolytes, such as are in the product.

EXAMPLE 4

| Component | Percent, by weight (as active component) |
|---|---|
| Sodium $C_{12-14}$ alcohol ethoxylate sulfate (containing 3 moles of ethylene oxide per mole) | 8.70 |
| +++ Nonionic surfactant (condensation product of one mole of $C_{13-15}$ fatty alcohol with seven moles of ethylene oxide and four moles of propylene oxide per mole | 2.50 |
| Amphoteric surfactant (Ampholak 7TX) | 1.80 |
| Coco fatty acid (stripped) | 1.50 |
| Sodium tripolyphosphate | 15.00 |
| Sodium bentonite (swellable) | 11.00 |
| Calcium hydroxide | 0.20 |
| Sodium hydroxide | 0.80 |
| Borax | 3.00 |
| Dibasic acid mixture (Sokalan DCS) | 2.00 |
| Sodium polyacrylate | 0.60 |
| Alcalase 2.5LDX (solids basis) | 0.60 |
| Perfume | 1.00 |
| Dye | 0.002 |
| Preservative (Kathon 886) | 0/0015 |
| Fluorescent brightener (Tinopal LMS-X) | 0.30 |
| Water | q.s. |
| | 100.00 |

+++ Replaceable by Lutensol ™ LF-400

The liquid detergent of the above formula is made by mixing together the following components, in the order given. First, ten parts of tap water are added to a suitable mixing vessel, followed by 0.3 part of the fluorescent brightener and 0.1 part of calcium hydroxide. Then a first pre-mix, comprising 1.5 parts of a coco fatty acid and 1.5 parts of the nonionic detergent are admixed with the brightener-calcium hydroxide solution and 0.1 part of sodium hydroxide, as a 49% aqueous solution, is added, followed by the rest of the water component of the product, 15 parts of sodium tripolyphosphate and 0.4 part of sodium polyacrylate. A second pre-mix is then admixed. It includes 8.7 parts of the anionic detergent (in a 28% aqueous solution), 2 parts of the diacid mixture, one part of the nonionic detergent, one part of perfume, 0.1 part of calcium hydroxide, three parts of granular borax, 0.7 part of sodium hydroxide (in a 50% aqueous solution), 0.002 part of blue dye (CI 61585) and 0.002 part of preservative (as 14% aqueous solution). Subsequently, to the base composition resulting, 1.8 parts of the amphoteric surfactant, 0.6 part of Alcalase 2.5LDX and 0.6 part of sodium polyacrylate (in Alcosperse 149, a 40% active product) are admixed. During the mixings the alkaline materials, e.g., NaOH and $Ca(OH)_2$, act to at least partially neutralize the acids present, but in the formula the acids and bases are separately indicated.

The liquid softergent resulting is of a viscosity of about 2,000 centipoises at 25° C. and the pH thereof is in the range of 7.2 to 7.5. The various components are dissolved, emulsified and/or dispersed in it and it is physically stable, without separation for at least six months, and the enzyme component thereof is still active after that time. The product exhibits essentially the same improved properties with respect to controls as does the product of Example 1, but sometimes to a slightly lesser degree. However, it is a more economical variation of that initial formula.

EXAMPLE 5

(Formula Variations)

In other formulas within the present invention the compositions of Examples 1 and 4 are modified by replacing ⅓ of the sodium tripolyphosphate with a mixture of equal parts of sodium carbonate and sodium bicarbonate and the product resulting is of essentially the same physical characteristics and will have similarly improved detersive and fabric softening properties. Such is also the situation when the anionic detergent is replaced by sodium lauryl alcohol sulfate, and/or sodium linear tridecylbenzene sulfonate, when the nonionic surfactant is replaced with a condensation product of $C_{12,13}$ alcohol and 7 EtO's/mole and when the bentonite employed is Wyoming or western bentonite, such as that sold under the tradename Hi-Jel No. 1, or is a carbonate-treated bentonite, such as Laviosa AGB. Also, similar products are obtainable when the enzyme employed is a mixture of proteolytic and amylolytic enzymes or when the Alcalase® 2.5L is replaced by Maxatase®, which is supplied by Gist-Brocades, Delft, Netherlands. In another variation of the Example 1 formula the 15% of sodium tripolyphosphate is replaced by 4% of sodium carbonate and 11% of Zeolite A to make a non-phosphate formula, which also is superior in cleaning and softening to its control.

Various other liquid softergents within the present invention are made by varying the proportions of the components of the formula of Example 1±10% and ±20%, while maintaining such proportions within the ranges set forth in this specification, and such proportions may be similarly modified with respect to the other formulas of the invented compositions that are mentioned in these examples. The products resulting will also be of a desired physical and performance characteristics.

In other variations of the invention the components of the liquid detergent, except for the aqueous medium are made in the form of a particulate composition, which is added to water to produce essentially the same wash water as is described in this example. In similar manner the various components are added to water separately or in sub-combinations to make wash waters of the same composition. All such wash waters produce the same beneficial effects as were described herein for the wash water made from the invented liquid detergent composition. When the detergent composition is in solid form, such as spray dried particles or granules, or when non-aqueous components are utilized the proportion of detergent composition or other materials charged to the wash water in the washing machine may be decreased accordingly, allowing for the greater proportions of active components present. For example, the concentration in the wash water of such materials may be lowered to 0.05 to 1.5%, about half of that for the liquid detergent compositions.

The invention has been described with respect to illustrations, embodiments and examples thereof but is not to be limited to these because it is evident that one of skill in the art, with the present specification before him/her, will be able to utilize substitutes and equivalents without departing from the invention.

What is claimed is:

1. A heavy duty liquid fabric softening laundry detergent composition which is of improved fabric softening and cleaning properties which comprises a surfactant system consisting essentially of an anionic surfactant, nonionic surfactant and an amphoteric surfactant said surfactant system includes 0.5 to 5% of an amphoteric surfactant of the formula $$R-(\underset{\underset{T}{|}}{N}-[CHR1]_x)_y-\underset{\underset{T}{|}}{N}-W$$

wherein R is a hydrocarbyl group of 8 to 20 carbon atoms, R1 is hydrogen or alkyl of 1 to 6 carbon atoms, R2 is alkylene of 1 to 6 carbon atoms, T is hydrogen or W, W is R2COOM, M is hydrogen, alkali metal, alkaline earth metal, ammonium or substituted ammonium, x is 2 to 3 and y is 2 to 4, said amphoteric surfactant being the sole amphoteric surfactant in the liquid laundry detergent composition; 2 to 15% of an anionic surfactant which is a higher alkyl ether sulfate which is a water-soluble salt of ethoxylated higher fatty alcohol sulfuric acid in which the higher fatty alcohol is of 8 to 20 carbon atoms and is ethoxylated with 2 to 6 moles of ethylene oxide per mole of fatty alcohol; 2 to 8% of an ethoxylated nonionic surfactant, 10 to 25% of water soluble inorganic builder salt; 4 to 15% of bentonite; and 30 to 80% of aqueous medium, with all percentages being by weight, said composition having a pH in the range of 7 to 8 and a viscosity in the range of 1500 to 2500 cps at 25° C.

2. A detergent composition according to claim 1 wherein the nonionic surfactant is a condensation product of a higher fatty alcohol of 10 to 18 carbon atoms with 3 to 15 moles of ethylene oxide per mole of fatty alcohol, the water soluble inorganic builder salt is selected from the group consisting of polyphosphates, carbonates, silicates and borates, and the aqueous medium is water.

3. A heavy duty detergent composition according to claim 2 wherein the amphoteric surfactant is of the formula $$R-(\underset{\underset{CH_2COOM}{|}}{N}-CH_2CH_2CH_2)_y-\underset{\underset{CH_2COOM}{|}}{N}-CH_2COOM,$$

wherein R is an aliphatic hydrocarbyl of 16 to 18 carbon atoms, M is alkali metal, and y is 3 to 4, the anionic surfactant is an alkali metal higher alkyl ether sulfate which is an alkali metal salt of ethoxylated higher fatty alcohol sulfuric acid in which the higher fatty alcohol is of 10 to 14 carbon atoms and is ethoxylated with 2 to 4 moles of ethylene oxide per mole of higher fatty alcohol, the nonionic surfactant is a condensation product of a higher fatty alcohol of 12 to 16 carbon atoms with 3 to 13 moles of lower alkylene oxide per mole of higher fatty alcohol, the water soluble inorganic builder salt includes alkali metal polyphosphate, and 40 to 75% by weight of water.

4. A heavy duty detergent composition according to claim 3 wherein, in the formula of the amphoteric surfactant, R is tallowalkyl, M is sodium and y is about 3.5, in the anionic surfactant the alkali metal is sodium, the higher fatty alcohol moiety is of about 12 carbon atoms and the ethoxy moiety is of about 3 ethoxy groups, in the nonionic surfactant the higher fatty alcohol moiety is of 12 to 15 carbon atoms and the ethoxy moiety is of about 5 ethoxy groups, the water soluble inorganic builder salt is sodium tripolyphosphate and the bentonite is a swellable bentonite, and the percentages by weight of said components in the composition are 1.5 to 4% of the amphoteric surfactant, 3 to 10% of the anionic surfactant, 2 to 5% of the nonionic surfactant, 10 to 20% of the builder salt and 7 to 13% of swelling bentonite.

5. A heavy duty detergent composition according to claim 4 which comprises 0.01 to 1% of an enzyme selected from the group consisting of proteolytic and amylolytic enzymes, and mixtures of such enzymes, and a stabilizing proportion of a combination of stabilizers for the enzyme(s), which stabilizing combination comprises, on a detergent composition basis, 0.1 to 0.5% of a source of calcium ion, 1 to 3% of boric acid or borax, and 0.5 to 5% of a mixture of dibasic acids of 4 to 6 carbon atoms each.

6. A heavy duty detergent composition according to claim 5 which comprises by weight in addition 0.1 to 2% of polyacrylate and 0.5 to 5% of higher fatty acid soap.

7. A heavy duty detergent composition according to claim 1 wherein the amphoteric surfactant is of the formula $$R-(\underset{\underset{CH_2COOM}{|}}{N}-CH_2CH_2CH_2)_y-\underset{\underset{CH_2COOM}{|}}{N}-CH_2COOM,$$

wherein R is an aliphatic hydrocarbyl of 16 to 18 carbon atoms, M is alkali metal, and y is 3 to 4, the nonionic surfactant is a condensation product of a higher fatty alcohol of 12 to 16 carbon atoms with 3 to 13 moles of lower alkylene oxide per mole of higher fatty alcohol and the water soluble inorganic builder salt includes alkali metal polyphosphate.

8. A process for washing and softening laundry that includes polyester and/or cotton and/or polyester/cotton blend fabrics which comprises washing the laundry in wash water of a hardness in the range of 0 to 400 p.p.m., as $CaCO_3$, at a temperature in the range of 10° to 90° C. with a concentration in the range of 0.1 to 3%, in the wash water, of a laundry detergent composition as described in claim 1.

9. A process according to claim 8 wherein the wash water is of a hardness in the range of 200 to 400 p.p.m., as $CaCO_3$, the washing temperature is in the range of 30° to 90° C., the liquid laundry detergent composition is that described in claim 3, and the concentration of the laundry detergent composition in the wash water is in the range of 1 to 2%.

10. A process according to claim 8 wherein the laundry is between three and six times soiled and laundered, and after a final washing the laundry is significantly whiter and softer than laundry similarly washed with a control composition that does not contain the amphoteric surfactant.

11. A process according to claim 9 wherein the laundry is repeatedly soiled and laundered, at least six times, and the laundry is significantly whiter and softer than laundry similarly repeatedly soiled and washed with a control composition that does not contain the amphoteric surfactant.

12. A process for washing and softening laundry which comprises washing the laundry in a wash water of a hardness in the range of 0 to 400 p.p.m., as $CaCO_3$, at a temperature in the range of 10° to 90° C. with a total concentration in the range of 0.05 to 1.5% in the wash water, of a laundry detergent composition as described in claim 1.

* * * * *